United States Patent [19]

Shumack, Jr.

[11] Patent Number: 4,781,413

[45] Date of Patent: Nov. 1, 1988

[54] PORTABLE STADIUM SEAT

[76] Inventor: George J. Shumack, Jr., 517 N. Front St., Allentown, Pa. 18102

[21] Appl. No.: 86,774

[22] Filed: Aug. 19, 1987

[51] Int. Cl.[4] ..... A47C 1/08

[52] U.S. Cl. ..... 297/252; 297/230; 297/194; 297/DIG. 3

[58] Field of Search ..... 297/252, 250, 254, 230, 297/231, DIG. 3, 194; 5/454

[56] References Cited

U.S. PATENT DOCUMENTS

| | | | |
|---|---|---|---|
| 388,037 | 8/1888 | Hargin | 5/454 |
| 2,507,639 | 5/1950 | Ledbetter | 297/252 |
| 3,117,327 | 1/1964 | Mathew | 297/194 |
| 3,133,696 | 5/1964 | Mirando | 5/454 |
| 3,572,836 | 3/1971 | Khanh | 297/DIG. 3 |
| 4,078,842 | 3/1978 | Zur | 297/DIG. 3 |
| 4,190,286 | 2/1980 | Bentley | 297/230 |
| 4,306,322 | 12/1981 | Young et al. | 5/454 |
| 4,484,781 | 11/1984 | Phelps | 297/DIG. 3 |
| 4,518,200 | 5/1985 | Armstrong | 297/DIG. 3 |
| 4,601,667 | 7/1986 | Hull | 297/250 |

*Primary Examiner*—Francis K. Zugel

*Attorney, Agent, or Firm*—Jerry T. Kearns

[57] ABSTRACT

A portable stadium seat for use over existing bleachers or stadium seats has a rigid frame on which an inflatable cushion is provided. The seat frame may have pivotally connected leg and head rest portions. The seat cushion may have a head rest, a lumbar support, a back rest, a seat portion and armrests all formed as separate compartments selectively connectable by a manifold valve to a footpump which is carried in a compartment in the seat cushion. A "U" shaped seat hook is pivotally connected to the underside of the seat frame and in one position, it is used to attach the seat frame over an exisiting stadium seat or bleacher, and in another position, it is received in a catch formed on the back of the seat frame to be used as a handle for transportation of the portable stadium seat.

2 Claims, 3 Drawing Sheets

PORTABLE STADIUM SEAT

BACKGROUND OF THE INVENTION

1. Field of the Invention

The present invention relates to portable stadium seats, and more particularly pertains to a portable stadium seat having a rigid frame on which an inflatable seat cushion is removably attached. The seat of the instant invention is designed for use by people having back problems who are normally precluded from attending sporting and cultural events by the hard and uncomfortable seating found in most stadiums and auditoriums.

2. Description of the Prior Art

Various types of portable stadium seats are known in the prior art. A typical example of such a portable stadium seat is to be found in U.S. Pat. No. Des. 215,543, which issued to J. Poor et al on Oct. 17, 1969. This patent discloses an inflatable pad held over an existing seat by a plurality of seat hooks attached to the pad. U.S. Pat No. Des. 277,917, which issued to B. Slakman on Mar. 12, 1985, discloses another inflatable pad to provide orthopedic back support. U.S. Pat. No. 5,518,200, which issued to W. Armstrong on May 21, 1985, discloses a seat pad for use over existing seats which has an inflatable lumbar support and a manually actuated hand pump. A cover secured by VELCRO hides the lumbar support from view. U.S Pat. No. 4,592,589, which issued to K. Hellwig on June 3, 1986, discloses an inflatable cushion for a chair which has a plurality of compartments which are shaped to provide orthopedic back support. U.S. Pat. No. 4,619,481, which issued to C. Grudzinskas on Oct. 28, 1986, discloses an inflatable seat pad, for use over existing seats, which has a plurality of compartments which are selectively inflated by a manifold system. A motorized compressor and a control system are provides for maintaining desired pressures in each compartment.

While the above mentioned devices are suited for their intended usage, none of these devices is suitble for use as a portable stadium seat by people with back problems. The aforesaid devices do not provide a rigid frame designed for proper orthopedic back support and do not utilize an easily portable design. The instant invention provides a seat with a rigid frame for proper orthopedic support and an inflated cushion for comfort in a compact, uncomplicated and easily portable design. Inasmuch as the art is relatively crowded with respect to these various types of portable stadium seats, it can be appreciated that there is a continuing need for and interest in improvements to such portable stadium seats, and in this respect, the present invention addresses this need and interest.

SUMMARY OF THE INVENTION

In view of the foregoing disadvantages inherent in the known types of portable stadium seats now present in the prior art, the present invention provides an improved portable stadium seat. As such, the general purpose of the present invention, which will be described subsequently in greater detail, is to provide a new and improved portable stadium seat which has all the advantages of the prior art portable stadium seats and none of the disadvantages.

To attain this, a representative embodiment of the concepts of the present invention is illustrated in the drawings and makes use of a rigid, adjustable seat frame on which an inflatable seat cushion is removably secured. A seat hook for securing the seat frame over an existing stadium seat or bleacher is pivotally attached to the underside of the seat frame. The seat hook also serves as a handle for carrying the portable stadium seat of the instant invention. A storage compartment for a manually actuated inflating pump is formed in the seat cushion. The seat cushion may be constructed as a plurality of separate compartments, each of which may be selectively connected to the manually actuated pump by a manifold valve. An inflatable arm rest having receptacles for food and beverage containers may be provided.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

. Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved portable stadium seat which has all the advantages of the prior art portable stadium seats and none of the disadvantages.

It is another object of the present invention to provide a new and improved portable stadium seat which may be easily and efficiently manufactured and marketed.

It is a further object of the present invention to provide a new and improved portable stadium seat which is of a durable and reliable construction.

An even further object of the present invention is to provide a new and improved portable stadium seat which is susceptible of a low cost of manufacture with regard to both materials and labor, and which accordingly is then susceptible of low prices of sale to the consuming public, thereby making such portable stadium seats economically available to the buying public.

Still yet another object of the present invention is to provide a new and improved portable stadium seat which provides in the apparatuses and methods of the prior art some of the advantages thereof, while simultaneously overcoming some of the disadvantages normally associated therewith.

Still another object of the present invention is to provide a new and improved portable stadium seat which has a rigid frame designed for proper orthopedic back support.

Yet another object of the present invention is to provide a new and improved portable stadium seat which has a seat hook which is utilized both for attaching the seat frame to an existing stadium seat or bleacher and as a carrying handle.

Even still another object of the present invention is to provide a new and improved portable stadium seat which has an adjustable, rigid seat frame.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
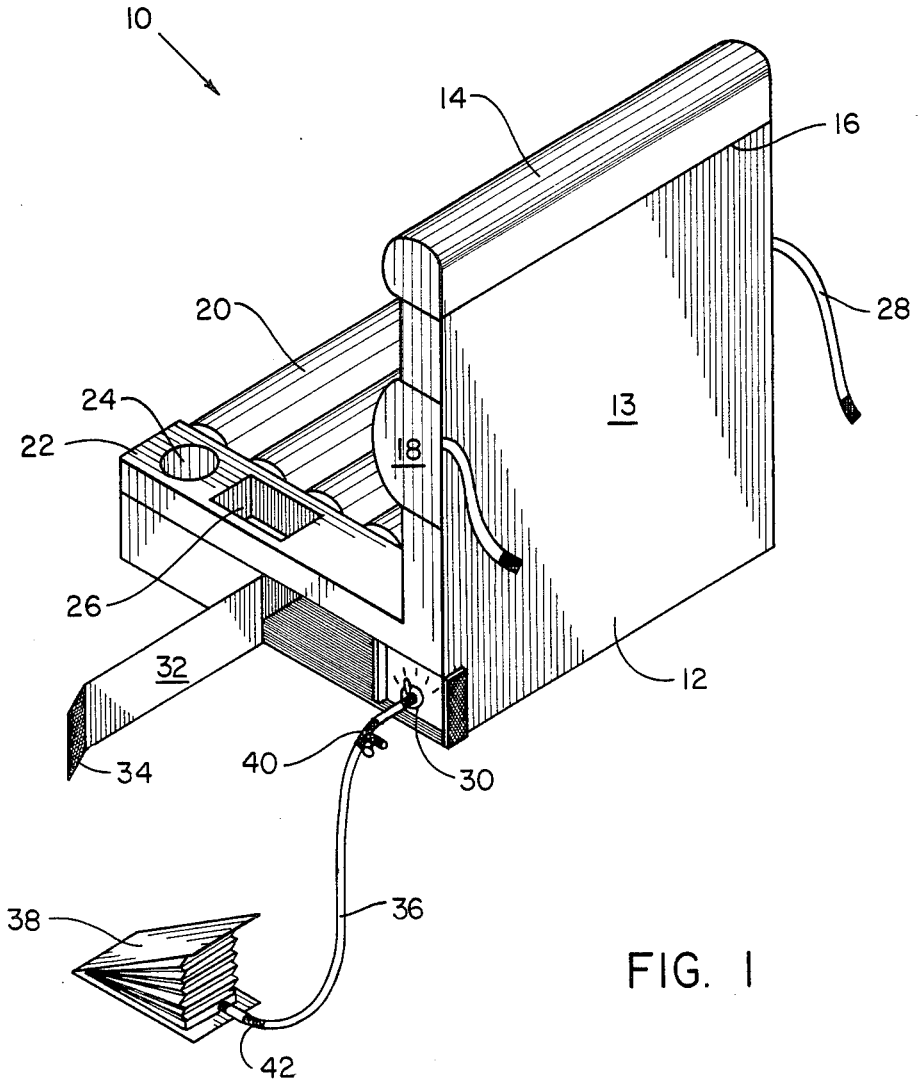
FIG. 1 is a perspective view of the inflatable seat cushion of the portable stadium seat of the instant invention.

With reference now to the drawings, and in particular to FIG. 1 thereof, a new and improved portable stadium seat embodying the principles and concepts of the present invention and generally designated by the reference numeral 10 will be described.

More specifically, it will be noted that the illustrated embodiment 10 of the invention includes an inflatable seat cushion 12 having a seat back cushion portion 13 to which a head rest 14 is pivotally connected by a fold line 16. A lumbar support 18 is formed on the seat back cushion portion 13. A seat cushion portion 20 having an arm rest 22 is formed integrally with the seat back cushion portion 13. The arm rest is provided with recesses 24 and 26 to be used as receptacles for beverage and food containers. Although only one arm rest is illustrated, it is readily apparent that two arm rests may be provided. The seat cushion portion 20, arm rest 22, seat back cushion portion 13, lumbar support 18 and head rest 14 may all be integrally formed as communicating chambers connected to a single valve, or each may be formed as separate chambers connected to a switchable manifold valve 30. In this case, the pressure in each chamber may be independently varied to meet the needs of each individual user. A plurality of straps 28 having VELCRO fasteners are provided for attaching the inflatable seat cushion 12 to the subsequently described seat frame. A manually actuated foot pump 38 is removably received in a compartment formed in the seat cushion 12. A flexible tube 36 connects the pump to the manifold valve 30. A pressure relief valve 40, for deflating selected chambers of the seat cushion 12, and a check valve 42, for maintaing pressure in the chambers during the return stroke of the foot pump 38, are provided. A door 32, having a VELCRO fastener 34, is utilized to secure the foot pump 38 in the compartment formed in the seat cushion 12 when it is not in use.

Figure 2:
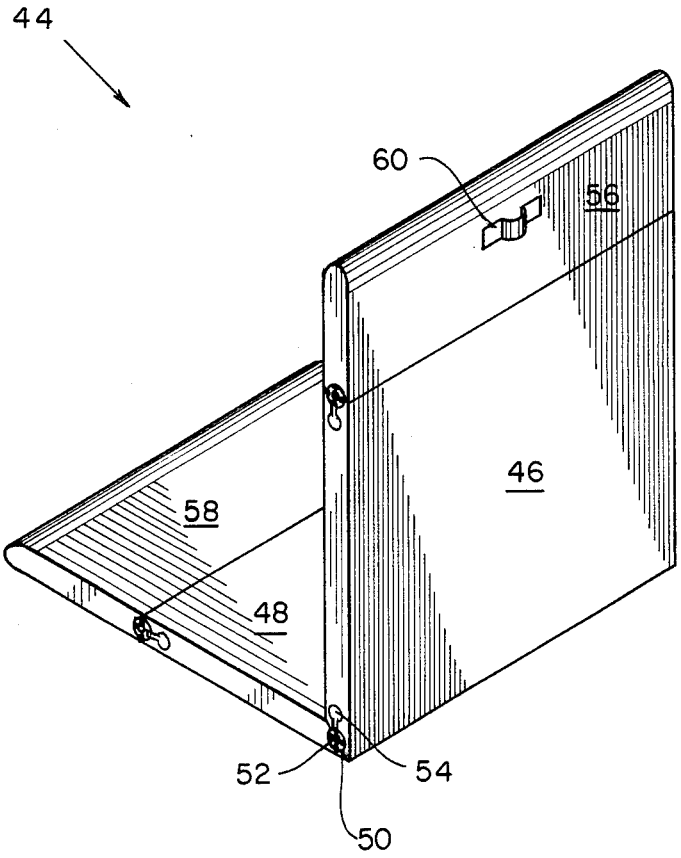
FIG. 2 is a perspective view of the adjustable, rigid seat frame of the instant invention.

With reference now to FIG. 2, a rigid seat frame 44 has a back rest frame portion 46 and a seat rest frame portion 48. Seat frame 44 may be constructed as an integral moulded plastic member, or for purposes of portability and adjustability, it may be formed from a plurality of rigid, moulded plastic components connected together by hinges. In the illustrated embodiment, seat rest frame portion 48 is connected to back rest frame portion 46 by a hinge mechanism. This hinge mechanism has a hinge pin 50 and a pivotal spring biased thumb lock 54, which cooperates with detent recesses in a detent wheel 52. Thus, by depressing the thumb lock 54 against the bias of a return spring, the angle between the seat rest frame portion 48 and the back rest frame portion may be adjusted as desired. A head rest frame portion 56 and a leg rest frame portion 58, mounted by the previously described adjustable hinge mechanism, may also be provided. A resilent plastic catch 60 is formed on a back side of the head rest frame portion 56 for a purpose to be subsequently described.

Figure 3:
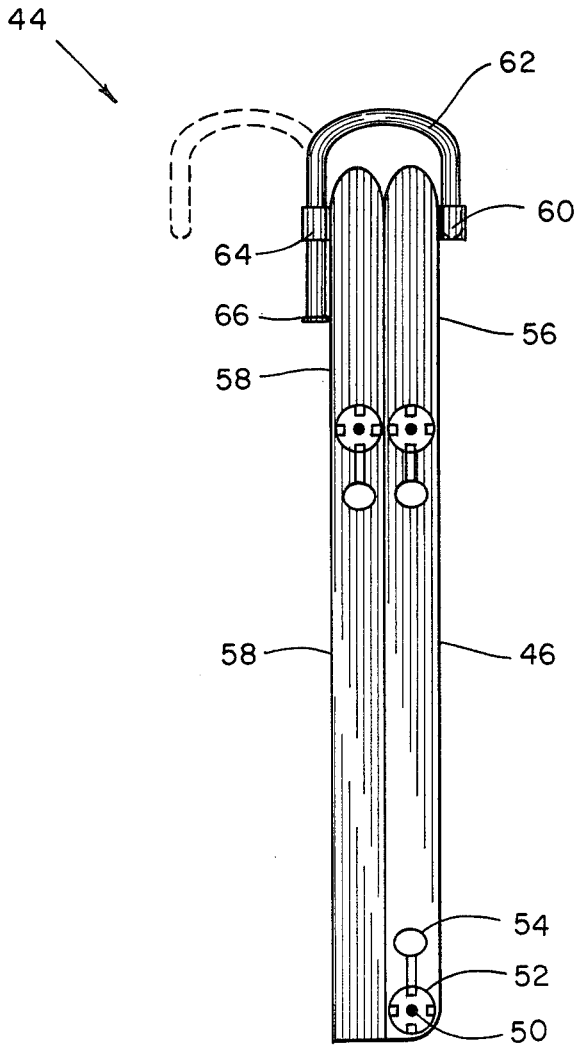
FIG. 3 is side view of the seat frame in a folded, closed position.

With reference now to FIG. 3, a side view illustrating the seat rest frame portion 48 and the back rest frame portion 46 folded to a closed position for transport is depicted. A generally "U" shaped seat hook and handle member 62 is pivotally received in a socket 64. Flanges 66 formed on one end of the seat hook 62 serve to retain the seat hook 62 in the pivot socket 64. In the illustrated position of the seat hook 62, one end is pivoted over the head rest portion 56 and received in resilent plastic catch 60 formed on the back of the head rest portion 56. In this position the seat hook 62 serves to retain the seat frame 44 in a closed, folded condition and also functions as a carrying handle. In the position of the seat hook illustrated in dotted lines, the seat hook is utilized to engage an existing bleacher or stadium seat to secure the portable stadium seat of the instant invention in position.

The manner of usage of the portable stadium seat of the instant invention will now be described. The seat frame 44 is transported to the place of use in the folded condition illustrated in FIG. 3. The seat hook 62 is removed from catch 60 and pivoted to the position illustrated in dotted lines. By depressing the appropriate thumb lock 54, the seat rest frame portion 48 and back rest frame portion 46 are pivoted to the open position illustrated in FIG. 2. The seat hook 62 is then engaged over the edge of the existing stadium seat or bleacher. The head rest frame portion 56 and leg rest frame portion 58 are then adjusted to the desired position by use of the appropriate thumb locks 54. At this point in time, seat cushion 12, which is in a noninflated condition, is placed over the seat frame 44 and secured by VELCRO straps 28. Door 32 is then opened and foot pump 38 is removed and placed on the floor. By setting manifold valve 30 to the appropriate position, the seat cushion portion 20, back cushion portion 13, arm rest 22, lumbar support 18 and head rest 14 are each selectively and successively connected to foot pump 38 and inflated to the desired pressure. The foot pump 38 is then returned to the compartment in the seat cushion 12 and door 32 is closed. When the event is over, the portable stadium seat cushion 12 is deflated by operation of manifold valve 30 with pressure relief valve 40 in an open position. The seat frame 44 is slid forwards to disengage seat hook 62 and then folded to a closed position as illustrated in FIG. 3. Note that the seat cushion 12 may be left secured to the seat frame 44 by straps 28. At this stage, the seat hook is pivoted from the dotted line position over the head rest frame portion 56 and is retained by catch 60. In this folded condition the portable stadium seat is carried by grasping seat hook (now handle) 62.

With respect to the above description then, it is to be realized that the optimum dimensional relationship for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved portable stadium seat for use on existing bleachers or stadium seats, comprising:

rigid seat frame means having a seat rest frame portion pivotally connected to a back rest frame portion by hinge means;

head rest frame means pivotally connected to said back rest frame portion by hinge means;

leg rest frame means pivotally connected to said seat rest frame portion;

generally "U" shaped seat hook means pivotally mounted on an underside of said leg rest frame means for attaching said seat frame means to said existing bleachers or stadium seats;

inflatable seat cushion means having a seat rest cushion portion and a back rest cushion portion;

means for attaching said seat cushion means to said seat frame means;

compartment means formed in said seat cushion means;

door means having latch means on said compartment means;

manually actuated pump means for inflating said seat cushion means removably received in said compartment means;

inflatable head rest means pivotally connected to said back cushion portion;

inflatable lumbar support means formed in said back cushion portion;

inflatable arm rest means on said seat cushion means having recesses for holding food and beverage containers;

manifold valve means for selectively connecting said manually actuated pump means to said seat cushion portion, said arm rest means, said head rest means, said lumbar support means and said back cushion portion; and catch means on a back side of said head rest frame means for releasably retaining an end portion of said "U" shaped seat hook means whereby said seat rest frame portion and said back rest frame portion may be pivoted and retained in a closed position by inserting an end portion of said "U" shaped seat hook means in said catch means.

2. The portable stadium seat of claim 1, wherein said means for attaching said seat cushion means to said seat frame means comprises a plurality of straps.

* * * * *